US006584881B1

(12) United States Patent
Boudreau et al.

(10) Patent No.: US 6,584,881 B1
(45) Date of Patent: Jul. 1, 2003

(54) MULTI-PURPOSE MISSILE LAUNCHER SYSTEM FOR A MILITARY LAND VEHICLE

(75) Inventors: David R. Boudreau, Brooklyn Park, MN (US); Stan Bovee, St Cloud, MN (US); Philip Matteson, White Bear Township, MN (US); Bruce Gaedke, Oak Grove, MN (US); Dennis Borgwarth, Anoka, MN (US)

(73) Assignee: United Defense LP, Arlington, VA (US)

( * ) Notice: Subject to any disclaimer, the term of this patent is extended or adjusted under 35 U.S.C. 154(b) by 92 days.

(21) Appl. No.: 09/817,490

(22) Filed: Mar. 26, 2001

(51) Int. Cl.[7] ..... F41A 9/00
(52) U.S. Cl. ..... 89/1.804; 89/1.815
(58) Field of Search ..... 89/1.804, 1.815, 89/1.8, 1.11

(56) References Cited

U.S. PATENT DOCUMENTS

| | | | | | |
|---|---|---|---|---|---|
| 2,866,384 | A | | 12/1958 | Hersh | |
| 3,106,132 | A | | 10/1963 | Biermann et al. | |
| 3,446,112 | A | * | 5/1969 | Planitzer et al. | 89/1.815 |
| 3,757,635 | A | | 9/1973 | Hickerson et al. | |
| 3,865,009 | A | | 2/1975 | Kongelbeck | |
| 3,895,557 | A | * | 7/1975 | Baumann | 89/1.815 |
| 3,943,870 | A | | 3/1976 | Paslay | |
| 3,946,640 | A | * | 3/1976 | Baumann | 89/1.815 |
| 4,004,487 | A | * | 1/1977 | Eichweber | 89/1.815 |
| 4,063,485 | A | | 12/1977 | Carter et al. | |
| 4,222,306 | A | | 9/1980 | Maury | |
| 4,305,325 | A | | 12/1981 | Lange et al. | |
| 4,501,187 | A | * | 2/1985 | White | 89/1.8 |
| 4,574,685 | A | | 3/1986 | Sanborn et al. | |
| 4,719,839 | A | * | 1/1988 | Smothers et al. | 89/1.802 |
| 4,733,596 | A | * | 3/1988 | Crow et al. | 89/34 |
| 4,791,852 | A | | 12/1988 | Fraud et al. | |
| 5,020,412 | A | | 6/1991 | Adams | |
| 5,123,327 | A | * | 6/1992 | Alston et al. | 89/1.813 |
| 5,129,307 | A | | 7/1992 | Cain et al. | |
| 5,129,308 | A | | 7/1992 | Fuereder et al. | |
| 5,269,214 | A | | 12/1993 | Badura et al. | |
| 5,452,640 | A | | 9/1995 | Bovee et al. | |
| 5,461,961 | A | | 10/1995 | Baus et al. | |
| 5,942,713 | A | * | 8/1999 | Basak | 89/1.816 |
| 6,000,313 | A | | 12/1999 | Becker et al. | |
| 6,125,734 | A | * | 10/2000 | Yagla | 89/1.816 |

* cited by examiner

*Primary Examiner*—Michael J. Carone
*Assistant Examiner*—M. Thomson
(74) *Attorney, Agent, or Firm*—Patterson, Thuente, Skaar & Christensen, P.A.

(57) ABSTRACT

A multi-purpose missile launcher system for a military land vehicle that has the capability for direct targeting both short and medium range land targets, as well launching missiles against longer-range land targets or air targets using indirect targeting. The mulit-purpose missile launcher system is deployed as part of a modular weapon system that mates with a modular bed of the military land vehicle.

7 Claims, 5 Drawing Sheets

MULTI-PURPOSE MISSILE LAUNCHER SYSTEM FOR A MILITARY LAND VEHICLE

FIELD OF THE INVENTION

The present invention relates generally to missile launcher systems. More particularly, the present invention relates to a multi-purpose missile launcher system for a military land vehicle that is preferably a modular system that mates with a modular bed of the military land vehicle.

BACKGROUND OF THE INVENTION

The use of weapon systems in connection with military land vehicles is well known. The tank is perhaps the most familiar of such vehicles, although smaller weapon systems such as machine guns, as well as mortar and artillery also have been adapted for use with a variety of military land vehicles often referred to as light armored vehicles.

The most common way of integrating a smaller weapon system onto a military land vehicle is to use a rotatable turret arrangement such as described in U.S. Pat. No. 4,574,685. The type of turret arrangement is the most flexible for targeting shorter range land based targets. Various ways in which a single larger gun or rocket system can be integrated with a military land vehicle are described in U.S. Pat. Nos. 5,129,308 and 6,000,313. These types of arrangements are better suited for long range or air-based targets. U.S. Pat. No. 3,757,635 describes a mulit-purpose munition carrier that can incorporate a single larger gun or rocket system and also features two detachable personnel capsules mounted in a pod-like arrangement on extensible arms of the tracked vehicle.

Until recently, the use of rocket and missile systems as a land-based weapon has been primarily limited to larger single rocket arrangements. Designs for the use of multiple rocket launching systems on ships have been known. U.S. Pat. Nos. 4,063,485 and 4,305,325 describe multiple decoy launcher systems for use with a ship that are fixed and positionable, respectively. U.S. Pat. Nos. 3,106,132 and 3,865,009 describe dual rotatable multiple rocket launcher systems also for use with a ship. U.S. Pat. No. 5,452,640 describes a multiple rocket launcher system for use with a ship that includes both fixed and positionable rocket launchers. U.S. Pat. No. 5,129,307 describes a pair of side-mounted rocket launcher systems that track simultaneously with an integrated naval gun. U.S. Pat. No. 5,020,412 also describes a pair of side-mounted rotatable rocket launcher systems that are integrated with a rocket magazine conveyer system on a ship.

Generally, the designs of multiple rocket launcher systems for ships are not well suited for use in connection with military land vehicles because of the significant differences in size, configuration and operation. U.S. Pat. No. 5,269,214 describes a plurality of projectile tubes that are mounted as part of a magazine block arrangement in a fixed orientation on a plate on the side of a tank, for example, as a defensive mechanism. Once the projectiles in a given magazine block have been fired, the magazine block is released by an operator from the plate and a new magazine block can be manually inserted into the plate. While this type of arrangement is adequate for smaller, shorter-range projectiles, it is not adequate for medium and larger size rocket launcher systems.

In recent years, there have been significant changes in the way in which military operations are conducted. Increasingly, the emphasis is on making ground-based military equipment lighter and more mobile so that the equipment can be easily transported to a desired location. Another emphasis has focused on designing military equipment to be more modular and make use of common components so as to decrease costs while increasing both flexibility and maintainability of the equipment. One example of this trend is the GTK European modular military vehicle which consists of an eight wheel driving module and a separable and detachable mission module that rides in a modular bed at the rear of the vehicle.

U.S. Pat. No. 5,461,961 describes a combat land vehicle with a rocket launcher that is separable for purposes of loading both components into an aircraft. The rocket launcher assembly includes a collar that rotates the rocket launcher in a horizontal orientation and an intermediate structure that raises and lowers the open end of the rocket launcher to adjust the elevation at which the rockets can be fired. While this arrangement allows multiple rocket launchers for medium and larger size rockets to be incorporated as part of a land military vehicle, the arrangement does not allow for a weapon system that can effectively target both short and medium range land targets, as well as launching rockets against longer-range land targets or air targets.

It would be desirable to provide a multi-purpose missile launcher system for a military land vehicle that can be deployed as part of a modular weapon system that mates with a modular bed of the military land vehicle and that has the capability of effectively targeting both short and medium range land targets, as well launching missiles against longer-range land targets or air targets.

SUMMARY OF THE INVENTION

The present invention is a multi-purpose missile launcher system for a military land vehicle that has the capability for direct targeting both short and medium range land targets, as well as launching missiles against longer-range land targets or air targets using indirect targeting. Preferably, the multi-purpose missile launcher system is deployed as part of a modular weapon system that mates with a modular bed of the military land vehicle.

A base structure is configured to operably and detachably mate with the modular bed of the military land vehicle. A first multiple missile system is operably attached to the base structure and selectively positionable in both vertical and horizontal orientations and selectively movable to multiple heights relative to the base structure for direct targeting of the first multiple missile system against short and medium range land targets. A second multiple missile system is also operably attached to the base structure, but in a fixed and generally vertical orientation for indirect targeting against long range land targets or against air targets. In the preferred embodiment, the first missile system includes at least a pair of independently positionable multiple missile modules carried in a retracted position during transport and selectively movable to an extended position for firing.

For purposes of the present invention, direct targeting will refer to the ability to position a missile system in an orientation in which the missile will be fired at a land based target generally along a line-of-sight target acquisition. Indirect targeting, on the other hand, will refer to the launching of a missile system at an altitude of greater than 45 degrees against a land target or launching a missile system against an air target.

DETAILED DESCRIPTION OF PREFERRED EMBODIMENTS

Figure 1:
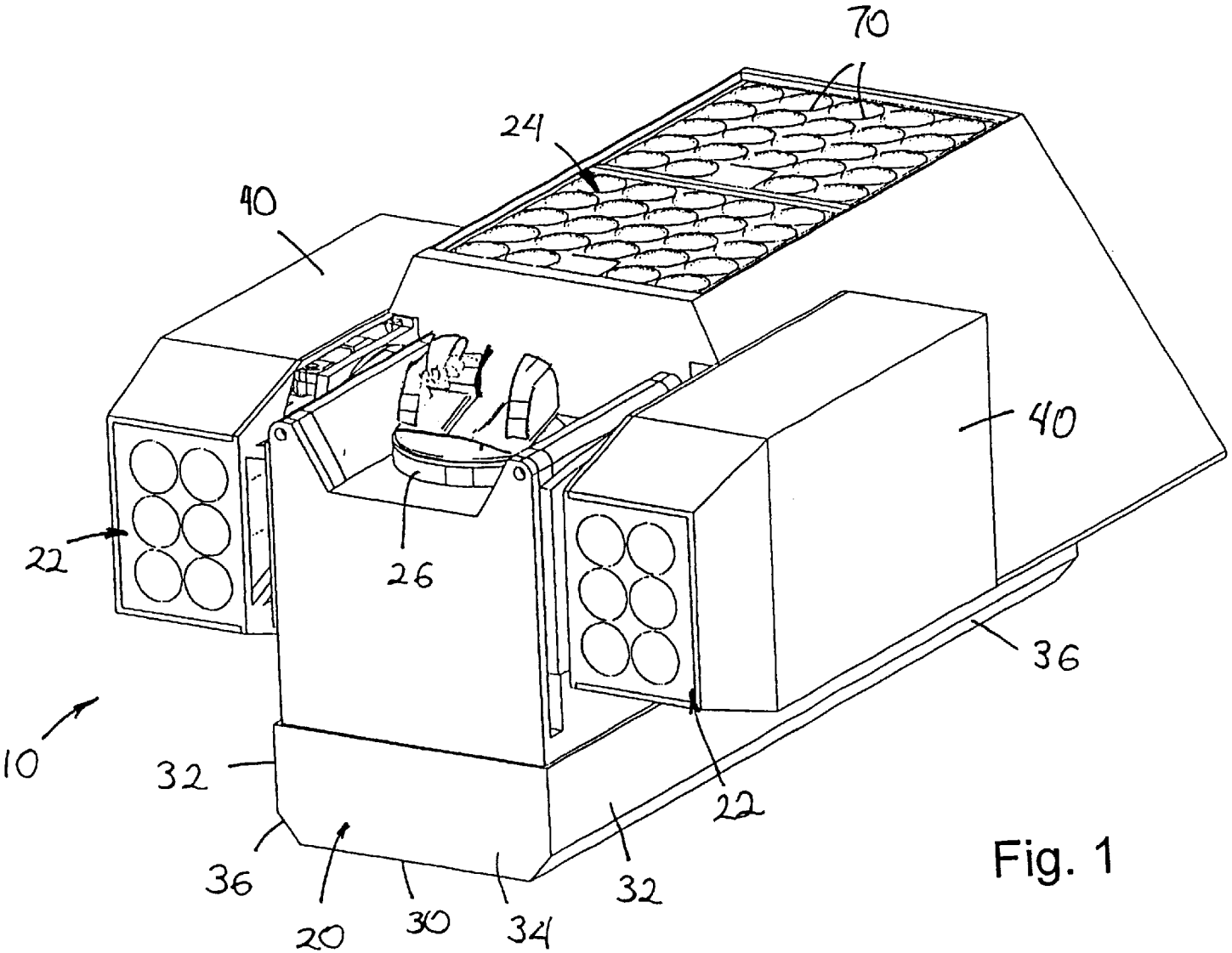
FIG. 1 is a perspective view of a multi-purpose missile launcher of the present invention with a first multiple missile system, a second multiple missile system and a third weapon system.
Figure 2:
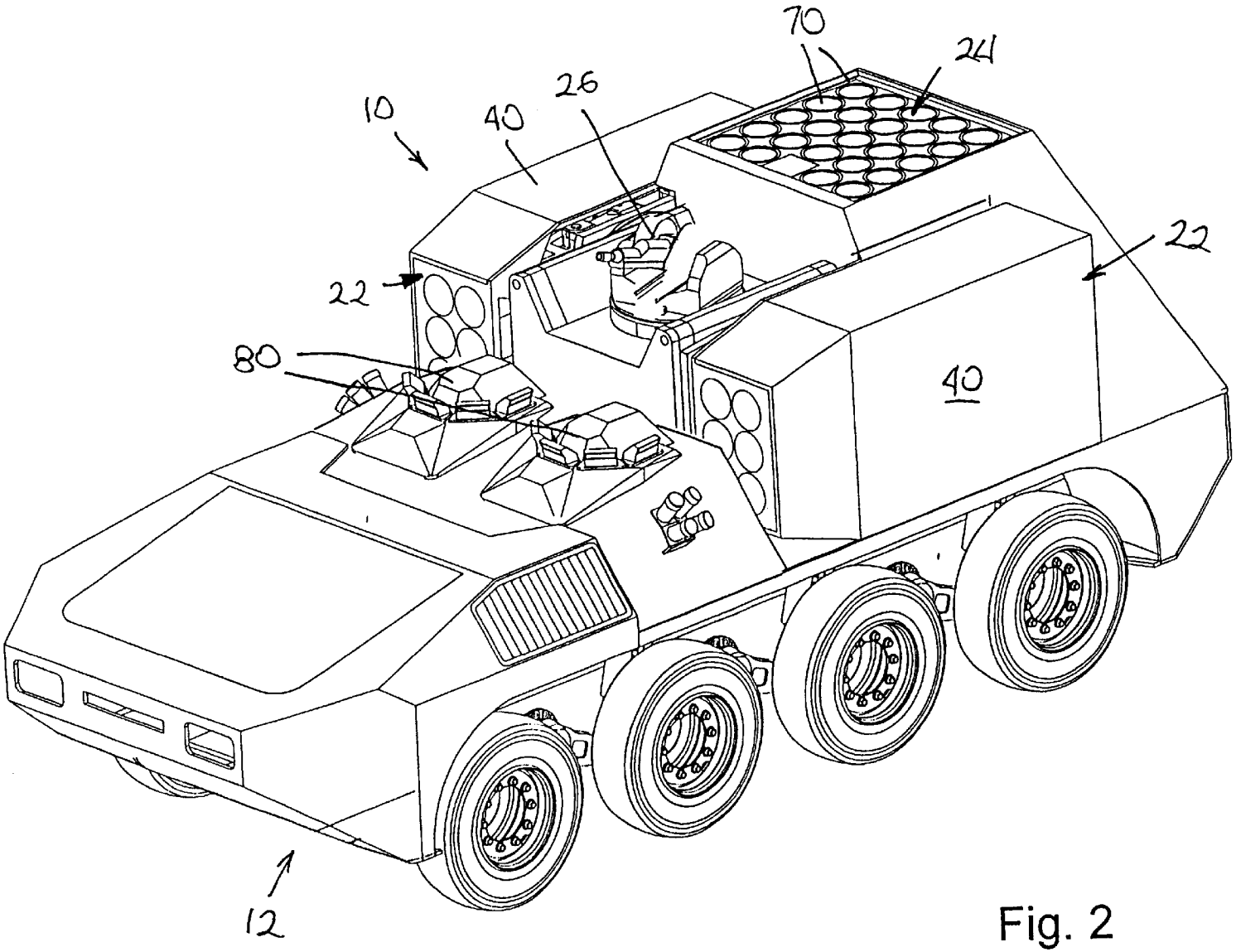
FIG. 2 is a perspective view of the multi-purpose missile launcher operably attached to a transport vehicle.

The present invention relates to a portable multi-purpose missile launcher, as most clearly illustrated at 10 in FIG. 1. The portable multi-purpose missile launcher 10 has an integrated, self-contained configuration that permits the multi-purpose missile launcher 10 to be loaded onto a military land vehicle 12, as illustrated in FIG. 2, to transport the multi-purpose missile launcher 10 to a location where the multi-purpose missile launcher 10 is to be used.

The multi-purpose missile launcher 10 preferably includes a base structure 20 and a weapon system platform. Operably attached to the weapon system platform is a first multiple missile system 22, a second multiple missile system 24 and a third weapon system 26. Each of the weapon systems is preferably designed to address a different type of potential target.

The base structure 20 has a generally rectangular shape and is formed with a length and width based upon the type of transport vehicle with which the multi-purpose missile launcher 10 is intended to be used. For most applications, the base structure 20 has a length that is preferably less than about 14 feet and a width that is preferably less than about 8 feet. Forming the base structure 20 with these dimensions permits the multi-purpose launcher 10 to be placed on conventional cargo trucks used by the military including a medium tactical vehicle used by the United States Army that is identified as M1083. The multi-purpose launcher 10 is also suitable for use with the M998 Series High-Mobility Multipurpose Wheeled Vehicles ("HMMWV," or "humvee," or "hummers") used by the United States Army.

The base structure 20 preferably has a bottom surface 30, a pair of side surfaces 32 and a pair of end surfaces 34 (only one of which is shown). The base structure 20 also preferably includes an angled surface 36 intermediate the bottom surface 30 and each of the side surfaces 32.

The components of the base structure 20 are each preferably fabricated from a metallic material that is capable of protecting the components placed in the base structure 20 from damage while transporting the multi-purpose missile launcher 10 to the location where the mulit-purpose missile launcher 10 is to be used. The base structure 20 is preferably fabricated with a substantially water-impervious configuration to prevent water from contacting components inside of the base structure 20.

The first multiple missile system 22 is preferably designed for striking ground-based targets that are located further from the multi-purpose missile launcher 10. The first multiple missile system 22 is also preferably designed for striking more thoroughly protected targets such as targets that are protected with armor.

The first multiple missile system 22 preferably includes a pair of first missile modules 40 that are mounted to either side of the base structure 20. The first multiple missile system 22 preferably includes the ability to aim the missile system in a horizontal manner, a vertical manner, or any plurality of orientations between horizontal and vertical. Providing the first multiple missile system 22 with a plurality of directional capabilities reduces the complexity and associated costs needed in guidance systems for the first multiple missile system 22.

Figure 3:
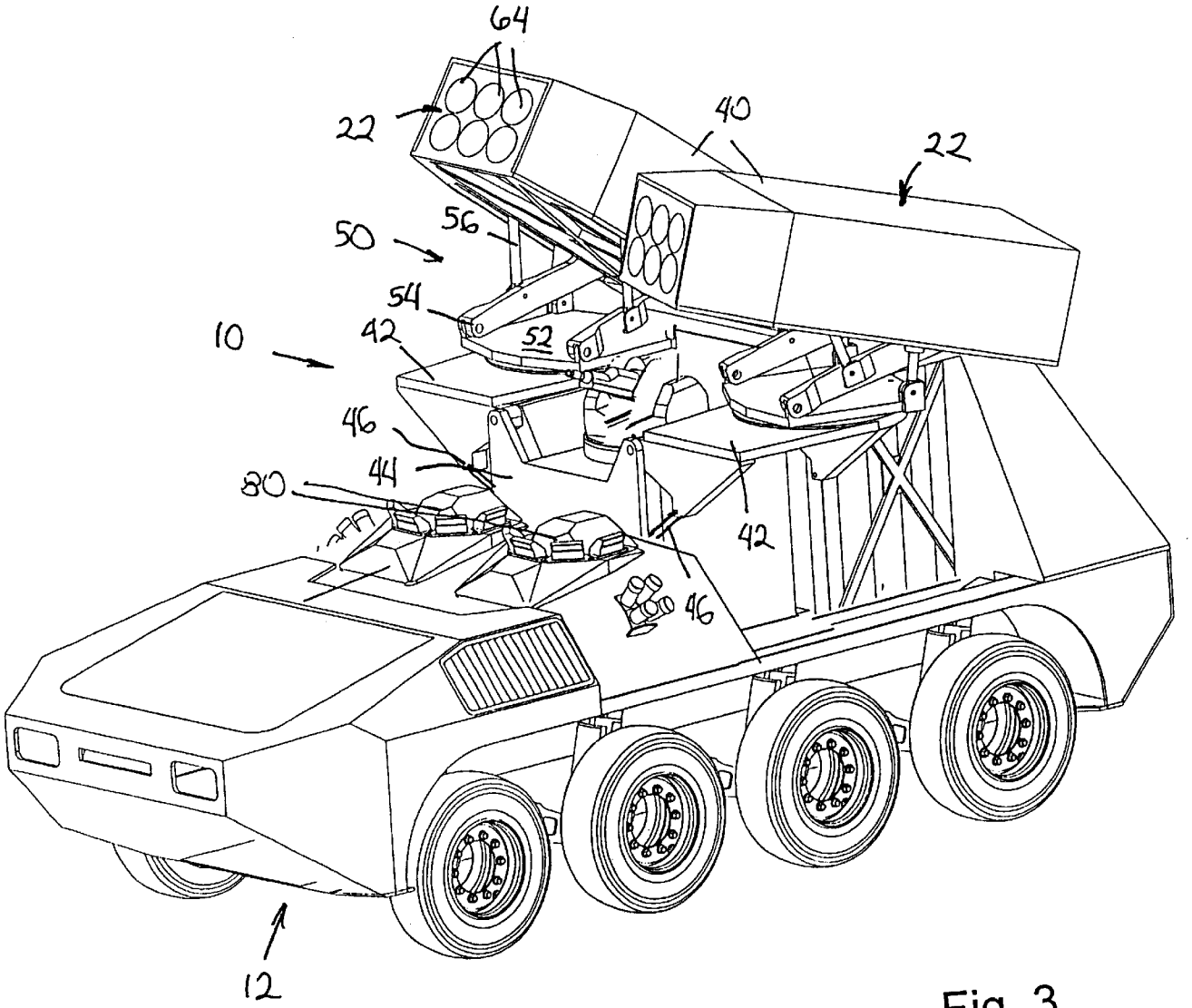
FIG. 3 is a perspective view of the multi-purpose missile launcher with a first multiple missile system in an extended position.

The first missile modules 40 are preferably mounted to move between a retracted position (as illustrated in FIG. 2) and an extended position (as illustrated in FIG. 3). Positioning the first missile modules 40 in the retracted position reduces the overall dimensions of the multi-purpose missile launcher 10 to facilitate transportation of the multi-purpose missile launcher 10 to a desired use location. For example, positioning the first missile modules 40 in the retracted position enables the multi-purpose missile launcher 10 and its transport vehicle to be placed on a conventional military transport plane such as a C130. Prior to use, the first missile modules 40 are pivoted from the retracted position to the extended position.

Each of the first multiple missile systems 22 also include a platform 42 that is pivotally mounted to an elevated central section 44. When in the retracted position, the platform 42 is preferably in a substantially vertical orientation. When in the extended position, the platform 42 is preferably in a substantially horizontal orientation. Pivoting of the platform 42 between the vertical orientation and the horizontal orientation is preferably controlled with a hydraulic cylinder or similar mechanism 46.

The missile module 40 is rotatably and pivotally mounted to the platform using a mounting mechanism 50. The mounting mechanism 50 includes a base 52, support arms 54 and a hydraulic cylinder 56. The base 52 is rotatably mounted to the platform 42. Rotation of the base 52 with respect to the platform 42 is preferably controlled by a motor (not shown) using techniques that are known to those having ordinary skill in the art.

The support arms 54 extend from the base 52 to the missile module 40 and thereby pivotally attach the missile module 40 to the base 52. The hydraulic cylinder 52 is operably attached between the missile module 40 and the base 52 and control pivoting of the missile module 40 with respect to the base 52.

Figure 4:
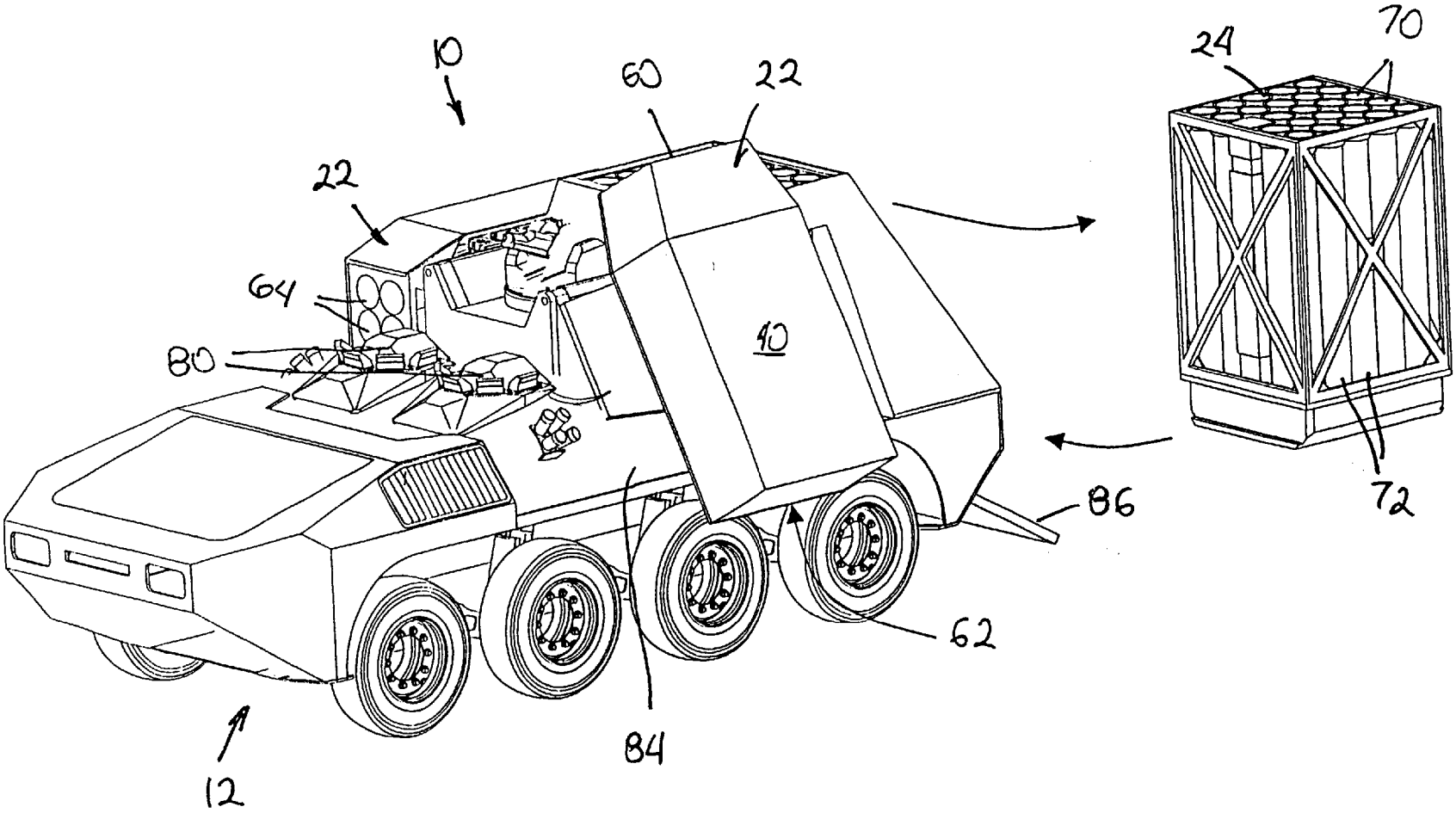
FIG. 4 is a perspective view of the multi-purpose missile launcher with the first multiple missile system in a reload position.
Figure 5:
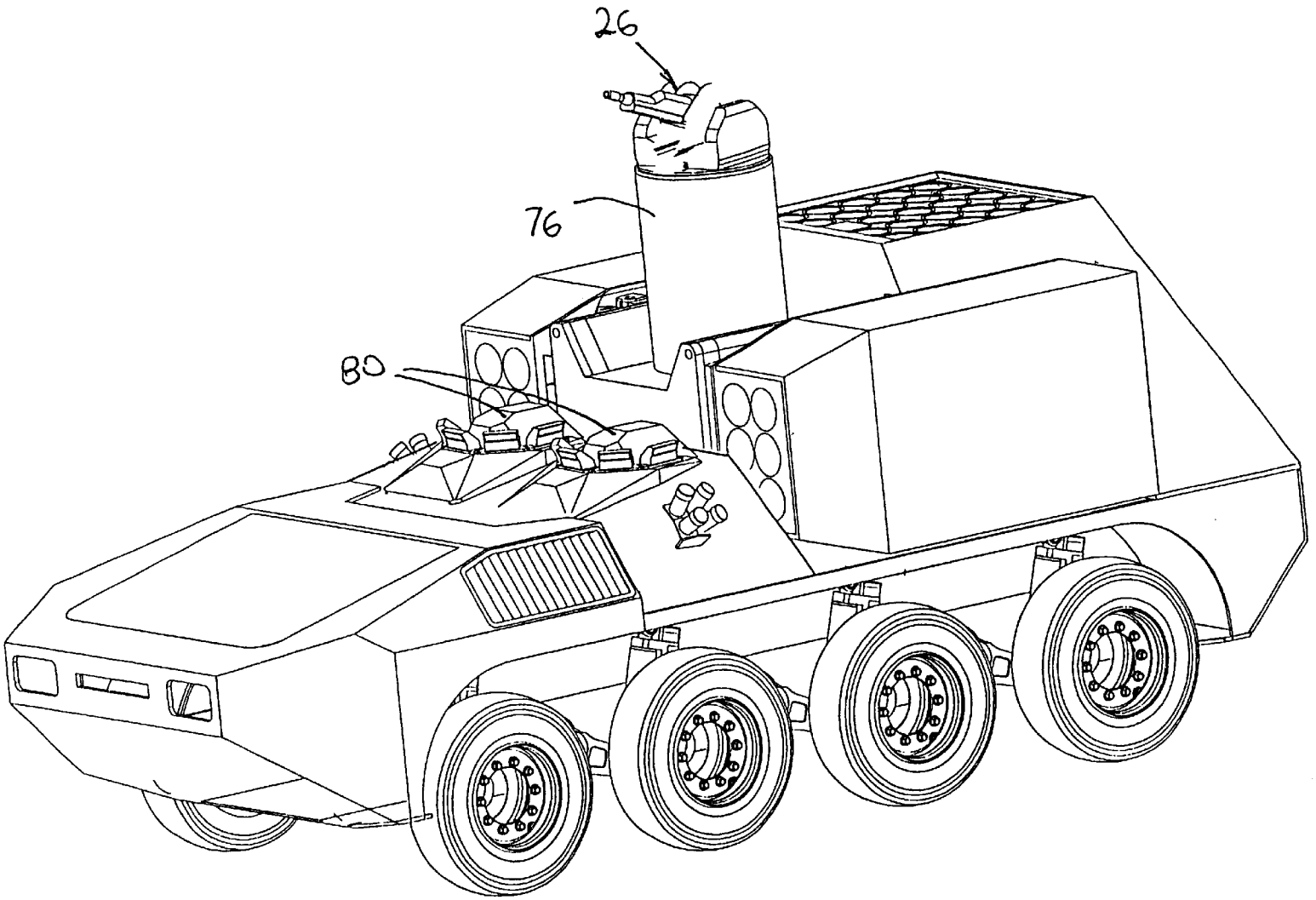
FIG. 5 is a perspective view of the multi-purpose missile launcher with the third weapon system in an extended position.

The first multiple missile system 22 is also preferably mounted for movement between the retracted position (as illustrated in FIG. 2) and a reloading position (as illustrated in FIG. 4). Movement of the first multiple missile system 22 to the reloading position is particularly suited for when the multi-purpose missile launcher 10 is on the transport vehicle 12 because when the first multiple missile system 22 is in the reloading position, the first missile modules 40 are sufficiently close to the ground surface to permit a person to manually reload the first missile modules 40 while standing on the ground.

The first missile module 40 is rotated with respect to the platform 42 so that the missile module 40 is in a generally vertical orientation with a front end 60 of the missile module 40 oriented above a back end 62 of the missile module 40. In this orientation the back end 62 is sufficiently close to the ground to permit missiles to be loaded into the missile module 40 through the back end 62.

The first missile module 40 is preferably configured to include an array of missiles 64. The number of missiles 64 included in each of the first missile modules 40 is selected based on the size of the individual missiles 64 and the size of the first missile modules 40. Preferably, each of the first missile modules 40 includes 6 missiles that are configured in an array having 3 columns and 2 rows. An example of a missile that is suitable for use with the present invention is available under the designation "Hellfire."

The second multiple missile system 24 is preferably designed for striking air-based targets or ground-based targets located a relatively far distance away from the multi-purpose missile launcher 10. The second multiple missile system 24 includes at least one missile 70 that is mounted in a substantially vertical orientation. The second multiple missile system 24 preferably has an array of missiles 70 that are aligned along rows and columns. In a preferred embodiment, there are 5 rows and 5 columns of missiles. However, a person of ordinary skill in the art will appreciate that the number of missiles 70 is selected based upon the size of the individual missiles 70 as well as the overall size of the second multiple missile system 24.

The second multiple missile system 24 is preferably configured in a modular manner that permits the entire second multiple missile system 24 to be separated from the multi-purpose missile launcher 10 when all of the missiles have been fired. Additionally and/or alternatively, the second multiple missile system 24 is configured to permit individual missile modules 72 to be removed therefrom. Removing individual missile modules 72 from the second multiple missile system 24 allows missiles that have specialized characteristics to be placed into the second multiple missile system 24.

Because the missiles used in conjunction with the second multiple missile system 24 are launched in a substantially vertical manner, the missiles 70 used in the second multiple missile system 24 must have more control circuitry than the missiles used in conjunction with the first multiple missile system 22 where the missiles are generally aimed towards the intended target before firing.

The third weapon system 26 is preferably designed for striking ground-based targets that are located a relatively short distance from the multi-purpose launcher 10. The third weapon system 26 preferably includes a conventional artillery gun. Alternatively, the third weapon system 26 may include more advanced guns that include guidance capabilities.

The third weapon system 26 is preferably mounted on a telescoping platform 76 that permits the third weapon system 26 to be moved vertically with respect to the multi-purpose missile launcher 10. Moving the third weapon system 26 vertically enables the third weapon system 26 to be positioned above obstacles located proximate the multi-purpose missile launcher 10.

The third weapon system 26 is preferably rotatably and pivotally mounted to the telescoping platform 76. Rotatably and pivotally mounting the third weapon system 26 to the platform 76 enables the third weapon system 26 to be pointed toward a desired target.

Operation of the multi-purpose missile launcher 10 is preferably controlled by a control system that is substantially located within the multi-purpose launcher 10. The control system includes all of the components needed to operate the first multiple missile system 22, the second multiple missile system 24, and the third weapon system 26.

In particular, the control system controls the movement of the first multiple missile system 22 between the retracted position, the extended position, and the reloading position. The control system also controls the horizontal rotation and the vertical pivoting of the first missile module 40 as well as the firing of the first missile module 40.

The control system also controls the firing of missiles 70 from the second multiple missile system 24. Additionally, the control system controls the vertical movement, rotation and pivoting of the third weapon system 26.

The multi-purpose launcher 10 preferably has a standardized size that permits the mulit-purpose launcher 10 to be used with transport vehicles 12 having a variety of characteristics that are selected based upon the area in which the multi-purpose launcher 10 is to be used. For example, the transport vehicle 12 may be motorized or non-motorized, wheeled or tracked. The transport vehicle 12 preferably has a motorized and wheeled configuration. Such a design enables the transport vehicle to travel on-road or off-road to the desired use location under its own power.

The transport vehicle 12 preferably includes a compartment 80 in which at least one person who is operating the transport vehicle 12 may sit. Preferably, the compartment 80 has space for 2 persons—one who has primary responsibility for driving the transport vehicle and one who has primary responsibility for controlling the operation of the multi-purpose launcher 10. Alternatively, operation of the transport vehicle 12 and the multi-purpose missile launcher 10 may be controlled remotely by operators who are located a distance away from the transport vehicle 12 and the multi-purpose missile launcher 10.

The transport vehicle 12 preferably includes a substantially flat support surface 82 (not shown) with a size that is approximately the same as the size of the transportable base 20 on the multi-purpose launcher 10. The transport vehicle 12 also preferably includes side supports 84 that extend around at least three sides of the multi-purpose launcher 10. The side supports 84 not only assist in retaining the multi-purpose launcher 10 in a desired location on the transport vehicle but also provide protection to a portion of the components in the multi-purpose launcher 10.

A back side of the transport vehicle 12 preferably has either a removable enclosure or no enclosure to permit either the entire multi-purpose launcher 10 or selected portions of the mulit-purpose launcher 10 to be readily removed from the transport vehicle 12 such as it is desired to change the components in the multi-purpose launcher 10 or it is necessary to reload the mulit-purpose launcher 10.

To facilitate replacing components such as the vertically oriented missile modules 72 without the use of equipment in addition to the transport vehicle 12, the transport vehicle 12 may include a lift mechanism 86. The lift mechanism 86 lowers spent vertically oriented missile modules 72 to a ground surface and then lifts replacement vertically oriented missile modules 12 to the height necessary for the vertically oriented missile modules 72 to be connected to the multi-purpose launcher 10. A person of ordinary skill in the art will appreciate that it is also possible to use the lift mechanism 86 to change the types of missiles in the multi-purpose launcher 10 for particular conditions under which the multi-purpose launcher 10 will be used such as using increased range missiles.

The lift mechanism 86 preferably includes at least two tines that extend therefrom in a configuration that is similar to a conventional forklift. When not in use the lift mechanism 86 preferably retracts into a position beneath the multi-purpose launcher 10.

The transport vehicle 12 also preferably includes a lateral movement mechanism 90 (not shown) that permits the banks of vertically oriented missiles to be moved laterally from their position in the multi-purpose launcher 10 to a position on the lift mechanism 86. A person of ordinary skill in the art will appreciate that a variety of configurations may be used for the lateral movement mechanism 90 such as a hydraulic cylinder.

In operation, the multi-purpose launcher 10 is placed on a transport vehicle 12 to transport the multi-purpose launcher 10 to a location where the multi-purpose launcher 10 is to be used. Once reaching the desired use location, the multi-purpose launcher 10 may be used from its position on the transport vehicle 12. Alternatively, the multi-purpose launcher 10 may be unloaded from the transport vehicle 12 and left at the operation location.

The multi-purpose launcher 10 does not require the transport vehicle 12 to have any special characteristics to permit the use of the multi-purpose launcher 10 from on the transport vehicle or when unloaded from the transport vehicle as all of the control circuitry needed to operate the multi-purpose launcher 10 is included in the multi-purpose launcher 10.

The control system of the multi-purpose launcher 10 permits the operation of the mulit-purpose launcher 10 to be controlled from a remote location using conventionally known communications technology such as transmitting the control instructions using radio signals.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A multi-purpose missile launcher module capable of being transported within a modular bed of a military land vehicle comprising:

a base structure configured to operably and detachably mate with the modular bed of the military land vehicle;

a first multiple missile system operably attached to the base structure and selectively positionable in both vertical and horizontal orientations and selectively movable to multiple heights relative to the base structure for direct targeting of the first multiple missile system against short and medium range land targets; and a second multiple missile system operably attached to the base structure in a fixed and generally vertical orientation for indirect targeting against long range land targets or against air targets.

2. The multi-purpose missile launcher of claim 1, wherein the first multiple missile system comprises:

a base pivotally mounted to the base structure;

a missile array that includes at least one missile; and a mounting mechanism that rotatably and pivotally attaches the missile array to the base.

3. The multi-purpose missile launcher of claim 1, wherein the first multiple missile system comprises first launching module and a second launching module, and wherein the first launching module and the second launching module each comprises:

a base that is pivotally mounted to the base structure;

a missile array that includes at least one missile; and a mounting mechanism that rotatably and pivotally attaches the missile array to the base.

4. The multi-purpose missile launcher of claim 1, wherein the first multiple missile system is movable between a retracted position and an extended position.

5. The multi-purpose missile launcher of claim 1, wherein the first multiple missile system is movable between a retracted position and a reload position.

6. The multi-purpose missile launcher of claim 1, wherein the second multiple missile system is removably attachable to the base structure.

7. The multi-purpose missile launcher of claim 1, wherein the second multiple missile system includes a plurality of missile modules removably mounted therein, and wherein each of the missile modules is capable of holding one missile.

* * * * *